US005349992A

United States Patent [19]

Gallo et al.

[11] Patent Number: 5,349,992

[45] Date of Patent: Sep. 27, 1994

[54] LIQUID DISTRIBUTION AND DISPENSING APPARATUS AND METHOD

[76] Inventors: Steven P. Gallo, 21 Aldom Cir., West Caldwell, N.J. 07006; Jack Fiorelli, 521 Rivervale Rd., Rivervale, N.J. 07675

[21] Appl. No.: 934,177

[22] Filed: Aug. 21, 1992

[51] Int. Cl.[5] ..... B65B 3/00

[52] U.S. Cl. ..... 141/18; 141/25; 141/2; 141/82; 141/85; 141/86; 141/98; 141/231; 141/311 A; 222/108; 222/146.6; 222/189; 222/386.5; 222/608; 137/358; 137/360; 137/899; 285/46; 285/64; 285/334; 62/390

[58] Field of Search ..... 141/18, 21, 98, 25-27, 141/85-89, 82, 1, 2, 3, 231, 311 A, 95, 114, 192, 198, 382, 384, 387-389; 222/108, 146.6, 189, 386.5, 389, 608; 137/351, 355.12, 355.16, 357, 360, 588, 899, 358; 285/46, 64, 334; 138/26, 30, 96 T; 62/390, 391

[56] References Cited

U.S. PATENT DOCUMENTS

| | | | |
|---|---|---|---|
| Re. 15,675 | 8/1923 | Skelly | 141/382 X |
| 491,828 | 2/1893 | West . | |
| 685,694 | 10/1901 | Schamp | 285/64 |
| 788,893 | 5/1905 | Dupuis | 222/30 |
| 1,047,452 | 12/1912 | Schottgen | 141/382 X |
| 1,694,772 | 12/1928 | Dean . | |
| 1,888,359 | 11/1932 | Ritchie | 137/360 X |
| 1,892,519 | 12/1932 | Schottgen | 141/27 |
| 2,781,798 | 2/1957 | McGovern et al. | 141/25 |
| 2,866,473 | 12/1958 | Schutter | 141/384 X |
| 2,931,382 | 4/1960 | Cirillo | 137/357 |
| 3,095,893 | 7/1963 | Martin | 137/216 |
| 3,493,496 | 2/1970 | Bray et al. | 222/386.5 X |
| 3,556,350 | 1/1971 | Hanley | 222/608 |
| 4,066,246 | 1/1978 | Korstvedt | 285/40 X |
| 4,485,831 | 12/1984 | Ungerleider | 137/1 |
| 4,641,693 | 2/1987 | Rakucewicz | 141/98 |
| 4,644,970 | 2/1987 | Lowry | 137/360 X |
| 4,646,793 | 3/1987 | Sherratt | 141/1 |
| 4,852,621 | 8/1989 | Bear | 141/198 X |
| 4,958,747 | 9/1990 | Sheets | 222/146.6 X |
| 4,962,789 | 10/1990 | Benscoter | 137/571 |
| 4,969,991 | 11/1990 | Valadez | 222/189 X |
| 5,240,043 | 8/1993 | Campbell | 137/899 |

*Primary Examiner*—J. Casimer Jacyna
*Attorney, Agent, or Firm*—Lawrence P. Trapani

[57] ABSTRACT

Apparatus and methods for distributing and dispensing a potable liquid are claimed. The apparatus comprises a faucet, and a storage tank. A conveying channel is provided for sanitarily conveying potable liquid from an outside source to the tank. The conveying channel includes a sanitary fitting containing an inlet channel. The fitting provides a detachable sanitary connection between the conveying channel and the source. A mechanism for draining free-standing liquid from the inlet channel is also provided. The inlet channel of the fitting terminates at a first coupling which contains an acme sanitary thread. A flow producing mechanism cooperates with the tank and the faucet for causing a flow of liquid from the tank upon the opening of the faucet. A discharge channel is connected to the faucet at one end and connected to receive the flow of liquid at its other end. The discharge channel conveys the flow of potable liquid to the faucet. The source comprises a vehicle with a supply tank mounted thereon. A mechanism, such as a pump, cooperates with the supply tank to cause a flow of liquid from the tank. A supply coupling contains an acme sanitary thread which is configured to closely mate with the acme thread of the first coupling. A hose is connected to the supply coupling at one end and connected to receive the flow of liquid from the supply tank at the other end. The hose conveys the flow of liquid to the supply coupling.

17 Claims, 4 Drawing Sheets

LIQUID DISTRIBUTION AND DISPENSING APPARATUS AND METHOD

BACKGROUND OF THE INVENTION

1. Technical Field

The present invention relates generally to the distribution and dispensing of potable liquids, and more particularly to an apparatus and method for distributing a potable liquid, in bulk, by a delivery vehicle and dispensing the potable liquid from a bulk storage reservoir.

2. Background Art

The conventional method of distributing and dispensing potable liquids generally involves the use of containers for packaging the liquid. On a commercial scale, such a method requires that a large number of package containers be manufactured, purchased, sterilized, filled, sealed, labeled, transported, stored, and otherwise handled before the liquid is ultimately dispensed. As a result, such a method has proven to be inefficient, cumbersome, labor intensive, and expensive.

The spring water trade is plagued by these same drawbacks. The product is usually distributed in 5 gallon bottles for use in such dispensing apparatus as water coolers, and in one gallon jugs in the retail market. In the case of water coolers, the bottles are large and heavy, and must be manually carried and installed at the dispensing location. The consumer must also take part in the distribution process by ensuring that the distributor has access to the water cooler. Such additional drawbacks to an already inefficient method of distribution has made it difficult and unattractive to develop domestic markets for dispensing systems such as water coolers. Similar difficulties have been experienced in commercial water cooler markets.

In the retail trade of spring water, the consumer is required to travel to the supermarket, fetch the container of water, and cart it home. At home, the container must be handled each time water is to be personally dispensed. Moreover, because the water is available only in relatively small containers, consumers must seek replenishing supplies on a frequent basis. The alternative is to purchase several containers of water at a time. However, this is a burdensome task for the ordinary consumer. In the retail trade, the consumer is very much involved in the distribution process before the spring water is actually dispensed. The inconvenience and expense of such a method have unfortunately resulted in consumer decisions to limit their consumption of healthy spring water.

In addition to the above, the use of package containers in distributing potable liquids presents potential hazards such as intentional or inadvertent contamination. Furthermore, package containers require either recycling or disposal, thus presenting added burdens and costs to consumers and their communities.

As early as 1905, systems have been proposed to eliminate the use of package containers in the distribution of potable liquids. In U.S. Pat. No. 788,893 (1905), an apparatus is disclosed which includes a bulk beverage delivery vehicle, bulk storage tanks, and a means for dispensing a beverage from the tanks. However, such a system is impracticable for potable liquids because adequate means are not described for ensuring that sanitary conditions are maintained, particularly at the point of connection between the vehicle and storage tanks.

SUMMARY OF THE INVENTION

It is therefore an object of the present invention to provide distribution and dispensing apparatus and methods for potable liquids that avoid the problems associated with the prior art.

It is another object of the present invention to provide distribution and dispensing apparatus and methods that eliminate the need for package containers in the distribution of a potable liquid, such as spring water.

It is a further object of the present invention to provide distribution and dispensing apparatus and methods that substantially eliminate the involvement and intervention of consumers in the distribution of a potable liquid, such as spring water.

It is yet another object of the present invention to provide distribution and dispensing apparatus and methods that ensure efficient and economical distribution of potable liquids to consumers.

It is yet a further object of the present invention to provide distribution and dispensing apparatus and methods that ensure a ready, convenient and continuous supply of a potable liquid, such as spring water.

It is still another object of the present invention to provide distribution and dispensing apparatus and methods that substantially reduce the frequency of replenishing a potable liquid supply.

It is still a further object to the present invention to provide distribution and dispensing apparatus and methods that reduce the likelihood of contamination during the refilling of a potable liquid supply.

These and other objects are attained in accordance with the present invention wherein there is provided an apparatus for distributing and dispensing a potable liquid. The dispensing apparatus comprises a faucet and a tank for storing a potable liquid. A liquid conveying channel is provided for sanitarily conveying potable liquid from an outside source to the tank. The conveying channel includes a sanitary inlet fitting containing an inlet channel. Potable liquid is made to pass through the inlet channel when the source is connected to the inlet fitting. The fitting provides a detachable sanitary connection between the conveying channel and the outside source. A mechanism for draining free-standing liquid from the inlet channel is also provided. The inlet channel terminates at one end at a first coupling. The first coupling contains an acme sanitary thread.

The apparatus further comprises a flow producing mechanism, which cooperates with the tank and the faucet, for causing a flow of potable liquid from the tank upon the opening of the faucet. A discharge channel, connected to the faucet at one end and connected to receive the flow of liquid at the other end, conveys the flow of liquid to the faucet.

The outside source comprises a distribution vehicle. A supply tank is mounted to the vehicle for holding and transporting a supply of potable liquid. A mechanism, such as a pump, cooperates with the supply tank to cause a flow of liquid from the tank. A supply coupling has an acme sanitary thread which is configured and dimensioned to closely mate with the acme thread of the first coupling. A hose is connected to the supply coupling at one end and connected to receive the flow of liquid from the supply tank at its other end. The hose conveys the flow of liquid to the supply coupling.

Methods for distributing and dispensing a potable liquid are also contemplated by the present invention. These methods comprise the steps of (1) transporting a bulk supply of potable liquid to a dispensing apparatus by using a distribution vehicle; (2) detachably connecting the bulk supply to a sanitary inlet fitting of the dispensing apparatus; (3) causing a flow of liquid from the distribution vehicle to the inlet fitting; (4) sanitarily conveying the liquid from the inlet fitting, through an inlet channel contained in the fitting, and to a storage tank in the dispensing apparatus; (5) detaching the bulk supply from the inlet fitting; (6) and causing any free-standing liquid in the inlet channel to drain out. These methods may further comprise the steps of (7) causing a flow of potable liquid from the storage tank of the dispensing apparatus upon the opening of a faucet; and (8) conveying the flow of liquid to the faucet.

BRIEF DESCRIPTION OF THE DRAWING

Further objects of the present invention will become apparent from the following description of the preferred embodiment with reference to the accompanying drawing, in which.

DESCRIPTION OF THE PREFERRED EMBODIMENT

Figure 1:
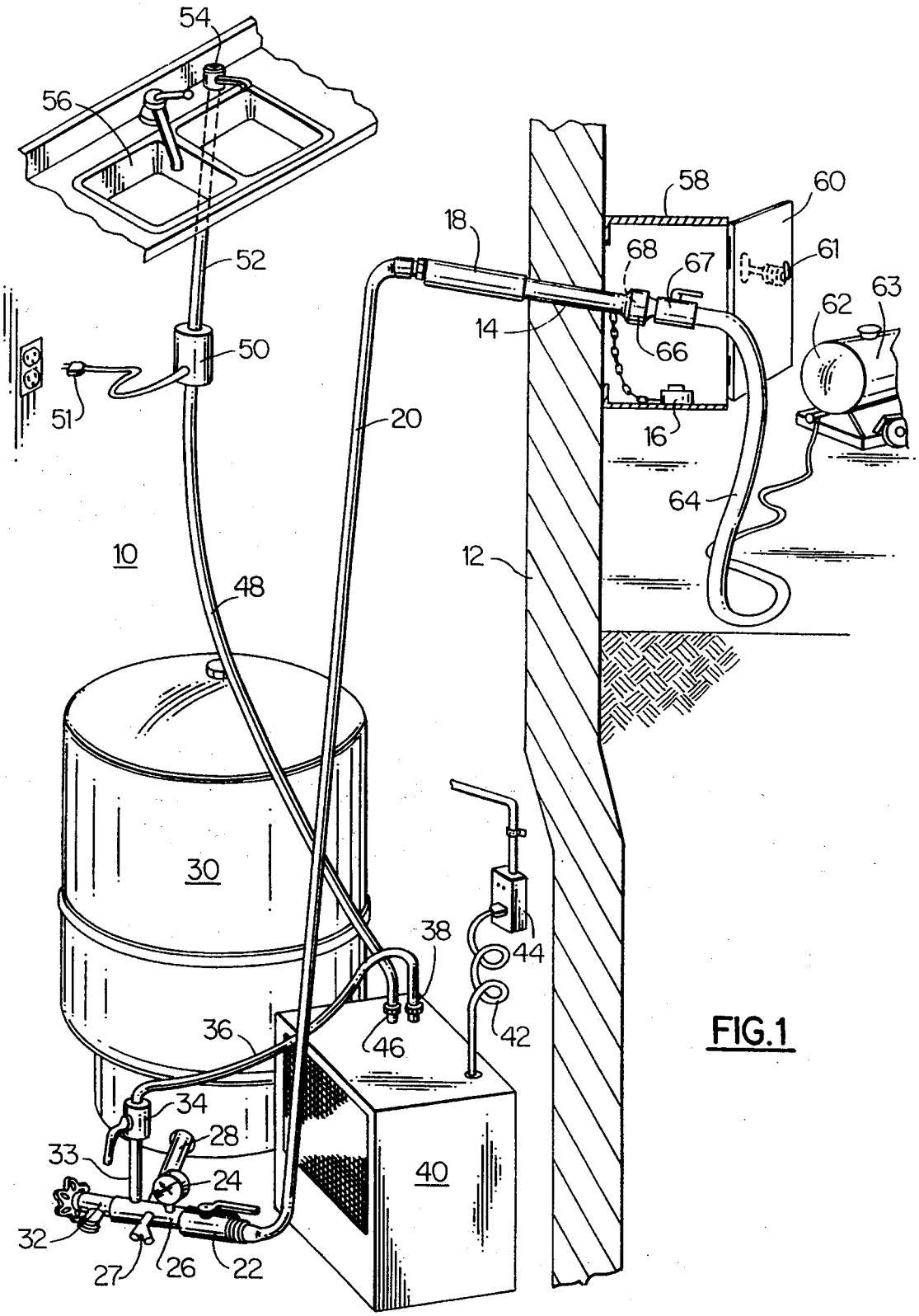
FIG. 1 is mainly a perspective view of a liquid distribution and dispensing apparatus embodying the teachings of the present invention, the dispensing apparatus being shown installed in a basement of a building.

Referring to FIG. 1 of the drawings, there is shown a perspective view of a liquid distribution and dispensing apparatus constructed in accordance with the present invention. A liquid dispensing apparatus 10 is installed in a basement of a dwelling and communicates with the outside of the dwelling through a foundation wall 12, as shown in FIG. 1. A polished, stainless steel, sanitary fitting 14 is installed through wall 12 to provide a novel inlet means for dispensing apparatus 10.

Figure 2:
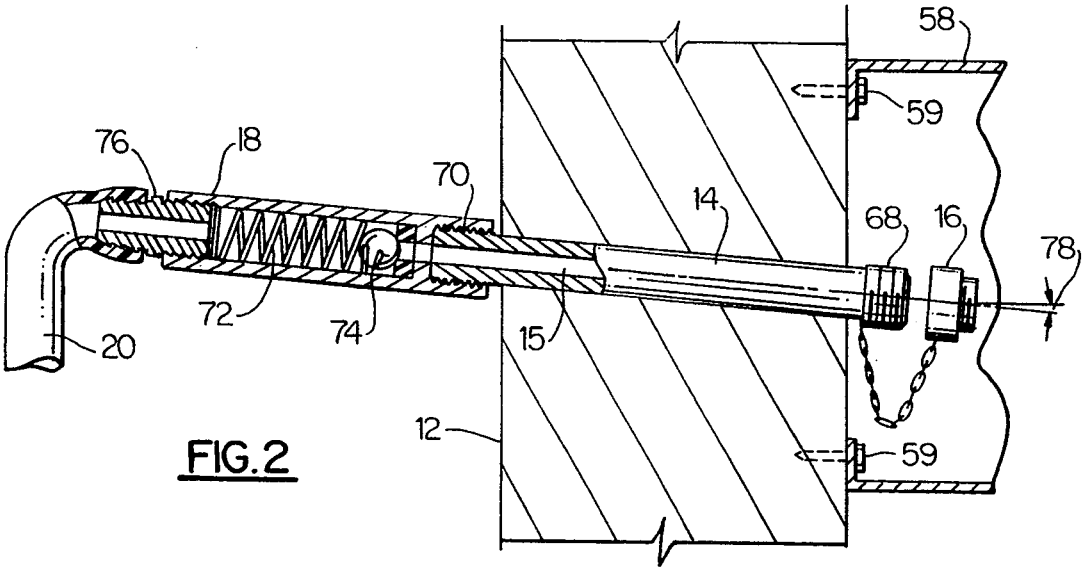
FIG. 2 is an enlarged sectional view of an installation of a sanitary inlet fitting, being a part of the dispensing apparatus of the present invention.

Fitting 14 contains an inlet channel 15 (FIG. 2) which terminates at a threaded coupling at each end of fitting 14. In the installation shown in FIG. 1, one coupling of fitting 14 projects out from the interior surface of wall 12 (inside coupling), and the other coupling projects out from the exterior surface of wall 12 (outside coupling). The length of fitting 14 is 16 inches, and its outside diameter is 1 inch. Fitting 14 is a custom made sanitary component, manufactured by Amsco Products of Fairfield, N.J. As shown in FIG. 2, fitting 14 includes a removable hex-shaped dust cap 16 secured to fitting 14 by a chain. Cap 16 is threaded so that it can be tightly screwed onto the outside coupling of fitting 14.

As shown in FIGS. 1 and 2, a spring loaded check valve 18 has its intake port threaded onto the inside coupling of fitting 14. Check valve 18 has a one inch inside diameter and is made of brass. Check valve 18 is a well known commercially available device, and is offered by a supplier such as Watts of North Andover, Mass.

A sanitary tube 20 is connected, at one end, to the discharge end of check valve 18, as shown in FIGS. 1 and 2. In the preferred embodiment, sanitary tube 20 has an inside diameter of one inch, and is made of a clear polyvinyl chloride (PVC) material. Sanitary tube 20 is a commercially available product. For example, it may be obtained from the Industrial Rubber Co. of Elizabeth, N.J. Sanitary tube 20 is connected, at its other end, to a conventional one inch, manually operated, brass ball valve 22. Ball valve 22 is normally open. It is closed only to perform maintenance and repair. Ahead of ball valve 22, is a ¼ inch pressure gauge 24 tapped into a pipe manifold 26. Ball valve 22 is directly connected, in-line, with manifold 26, as shown in FIG. 1. Also tapped into manifold 26 is a conventional pressure relief valve 27 which has a release threshold pressure of 75 lbs per square inch. Such a valve is commercially available from Atlas of Hackensack, N.J.

Also tapped into manifold 26 is a communication pipe 28, as shown in FIG. 1. Communication pipe 28 is connected to and communicates with a 52 gallon, pre-pressurized, diaphragm action tank 30. Tank 30 is a commercially available item. For example, a suitable tank is the Model MPD52, manufactured by Myers of Ashland, Ohio. Tank 30 contains an expandable elastomeric diaphragm contained within its housing. The diaphragm is the container for the liquid to be stored in the tank. The diaphragm in Tank 30 is rated for maximum pressure of 80 lbs per square inch at full capacity.

The Model MPD52 has a pre-charge of air pressure between the tank housing and the diaphragm of 40 lbs per square inch over atmospheric pressure. A valve on the tank allows this pressure to be adjusted. In the application of the invention shown in FIG. 1, the pre-charge in the Model MPD52 is adjusted to 5 lbs per square inch over atmospheric pressure. This reduced amount was empirically determined for an expected maximum tank capacity of 40 gallons, and is more than adequate to produce the required flow pressure for this embodiment.

Pipe 28 is both the intake path and discharge path for tank 30. In the preferred embodiment, tank 30 contains means for causing a flow of liquid out of tank 30. The flow causing means involves two forces. The first is produced by the elastic diaphragm which is expanded by the presence of liquid. The second force is produced by the pre-charge pressure (e.g., 5 lbs) pushing down on the diaphragm. A separate pump for apparatus 10 is not required to produce the required flow pressure.

As shown in FIG. 1, a manually operated water tap 32 is threaded onto pipe manifold 26. Water tap 32 provides a means for locally drawing liquid from tank 30, and for draining the system, if necessary, during maintenance or repair. An extension pipe 33 is also tapped into manifold 26 at one end, and connected to a ¼ inch manually operated brass ball valve 34 at its other end. Like valve 22, ball valve 34 is normally open, and is closed only to perform maintenance and repair. Such ball valves are commercially available, for example, from Watts of North Andover, Mass. Connected at the other end of ball valve 34 is a ¼ inch sanitary tube 36 which is, in turn, connected to an inlet coupling 38 of an electric water chiller 40.

As shown in FIG. 1, water chiller 40 has an electrical power cord 42 plugged into a standard 120 volt wall outlet 44. Water chiller 40 is a refrigerated unit, containing a coiled cooling pipe (not shown) which is connected in-line with sanitary tube 36. The construction and operation of water chiller 40 are well known, and such units are commercially available. For example, the Model ER1, manufactured by Elkay of Oakbrook, Ill., is a suitable water chiller for the application shown in FIG. 1. The coiled cooling pipe of water chiller 40 terminate at a discharge port (not shown) in which a outlet tube coupling 46 is mounted.

A ¼ inch clear PVC sanitary tube 48 is connected to outlet coupling 46 and to a UV liquid purifier 50. UV purifier 50 contains an electrical cord 51 which is plugged into a standard 120 volt outlet. UV purifier 50 has a cylindrical polypropylene chamber, as represented in FIG. 1. The chamber contains a clear tubular channel (not shown) passing therethrough. The channel begins at an intake coupling and ends at an outlet coupling. Sanitary tube 48 is connected to the intake coupling and a ¼ inch clear PVC sanitary tube 52 is connected to the outlet coupling. Located within the chamber of purifier 50 is at least one high intensity ultra-violet lamp. The ultra-violet radiation from the lamp is emitted through the clear channel in the chamber so as to illuminate liquid flowing through the channel from tube 48 to tube 52. As a result of this illumination, any disease-causing (pathogenic) micro-organisms in the liquid are destroyed. Purifier 50 should produce a high purity of water at a flow rate of one gallon per minute. UV purifier 50 may be, for example a Model P-1 made by Ultra Dynamics Corporation of Sànta Monica, Calif. UV purifier 50 may also include a sediment filter cartridge for eliminating any sediment contained in the liquid as it flows through the unit.

In place of, or in addition to a UV purifier, a white cellulose fiber filter may be included in-line between tube 48 and tube 52. An example of such a filter is the Model 1P753, 5 micron white cellulose fiber filter, made by AQUAPURE.

With further reference to FIG. 1, there is shown sanitary tube 52 connected to a dedicated, stainless steel, cold water faucet 54. The term "faucet," as used in this application, means any valve or other device for drawing a flow of potable liquid from a pipe, tube, tank or other reservoir. Cold water faucet 54 is installed in a conventional kitchen sink 56. UV purifier 50 may be installed directly under kitchen sink 56, or down in the basement, near water chiller 40. Faucet 54 may be, for example, a Model 2156, manufactured by Elkay of Oakbrook, Ill.

At the inlet end of apparatus 10, the outside coupling of fitting 14 is enclosed in a sturdy, stainless steel, lock box 58, as shown in FIG. 1. Lock box 58 is secured to foundation wall 12 by lag bolts 59, shown in FIG. 2. Lock box 58 contains a hinged door 60 having a latch 61. Latch 61 includes a lock which securely locks door 60 closed with the use of a key (See FIG. 1).

It is apparent from the above description that the liquid path between coupling 68 and tank 30 provides a means for conveying liquid from an outside source to tank 30. In the preferred embodiment, the conveying means comprises inlet channel 15 of fitting 14, check valve 18, sanitary tube 20, ball valve 22, manifold 26 and communication pipe 28. In addition, the liquid path between tank 30 (in the configuration of FIG. 1) and faucet 54 provides a discharge channel for conveying a flow of potable liquid from the diaphragm of tank 30 to faucet 54. In the preferred embodiment, the discharge channel comprises communication pipe 28, manifold 26, extension pipe 33, ball valve 34, tube 36, chiller 40, tube 48, purifier/filter 50, and tube 52.

Figure 4:
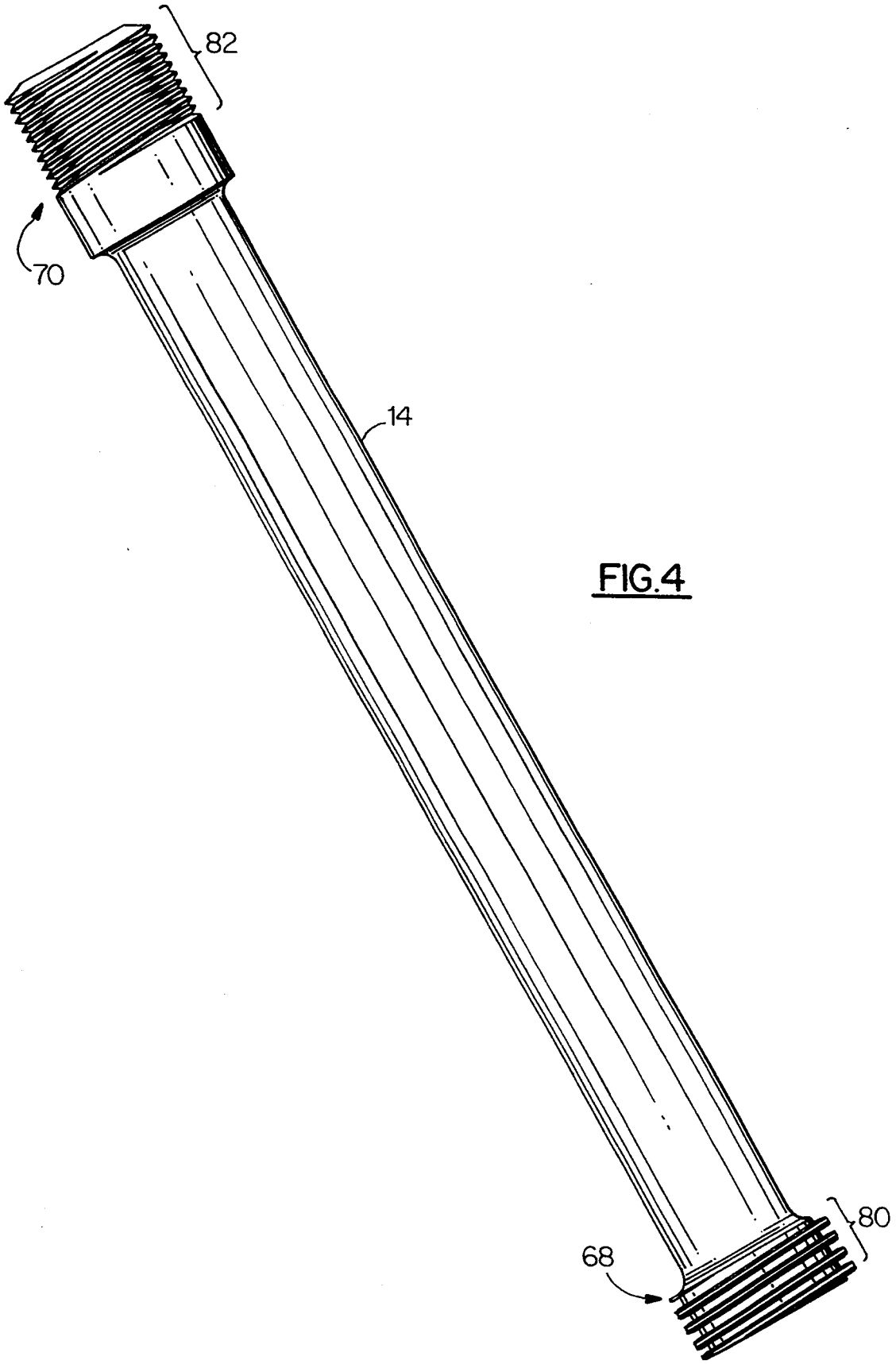
FIG. 4 is an elevation view of the sanitary inlet fitting of the present invention, showing detail of the threaded couplings at each end of the fitting.
Figure 6:
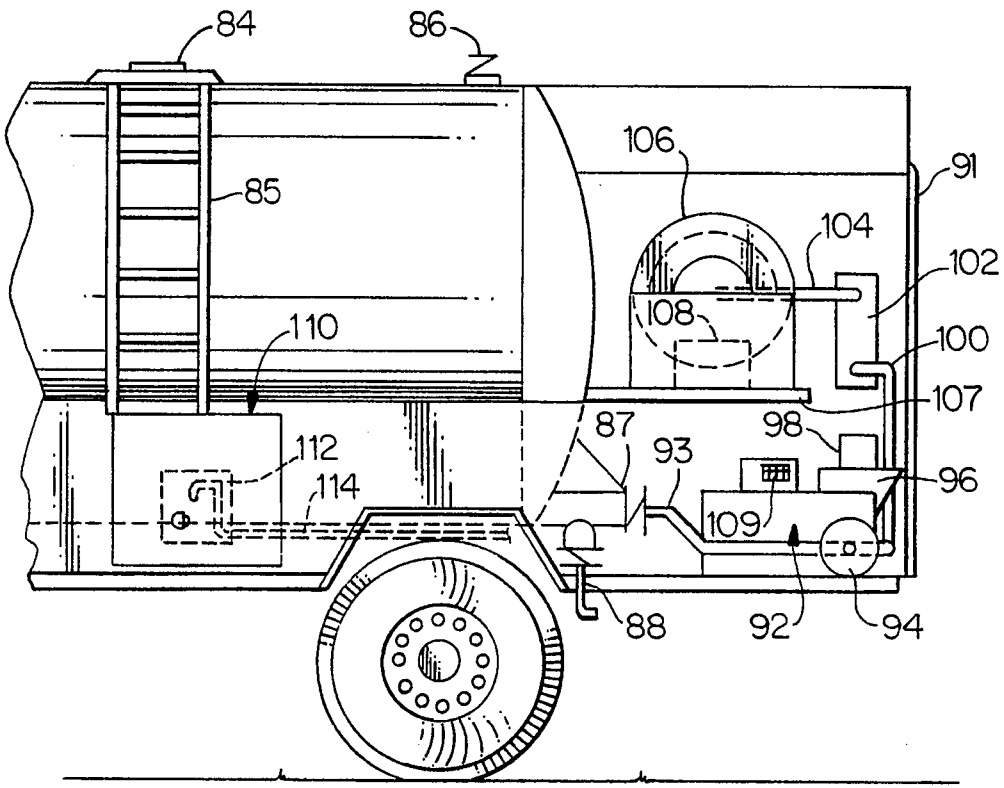
FIG. 6 is a diagrammatic sketch showing a side elevation view of the distribution apparatus of FIG. 5.
Figure 5:
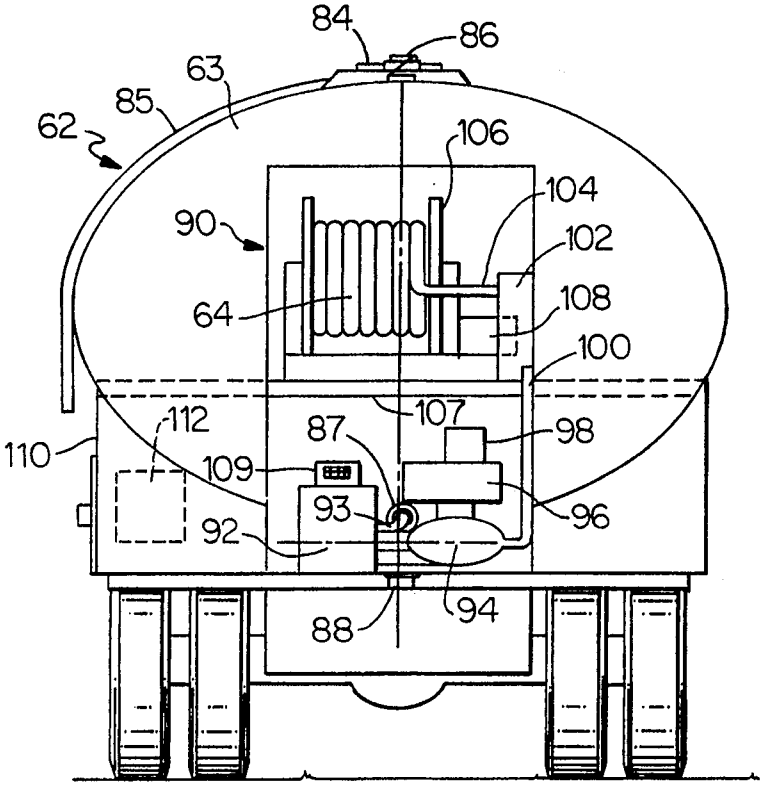
FIG. 5 is a diagrammatic sketch showing a rear elevation view of the distribution apparatus of the present invention embodied in a tank truck.

In accordance with the objects of the present invention, potable liquid, such as spring water, is delivered to dispensing apparatus 10 by a distribution apparatus, such as tank truck 62 (See FIGS. 1, 5 and 6). Truck 62 includes a 100 foot sanitary supply hose 64 having a nozzle or coupling 66. Contained in-line with supply hose 64, adjacent to nozzle 66, is a 1 inch, manually operated, brass ball valve 67, as shown in FIG. 1. Coupling 66 contains an internal sanitary thread configured and dimensioned to closely mate with an external sanitary thread contained on the outer coupling of fitting 14. Further details of the sanitary thread are provided below with reference to FIG. 4.

Referring to FIG. 2, the outer coupling (now designated by reference number 68) projects out from the exterior surface of wall 12. The inner coupling of fitting 14 (now designated by reference number 70) projects out from the interior surface of wall 12. Inner coupling 70 contains a "standard" or "national" thread, and is threaded into the intake port of check valve 18, as shown in FIG. 2. Check valve 18 comprises a compression spring 72 which is urged against a seated check ball 74, in a well-known manner. Check valve 18 permits the flow of water under pressure in only one direction, going from its intake port to its discharge port. The purpose of check valve 18 is to prevent any loss of pressure and liquid from apparatus 10 through fitting 14.

As shown in FIG. 2, a male tube adapter 76 is threaded into the discharge port of check valve 18. Adapter 76 includes an engagement nipple to which tube 20 is connected. The connection of tube 20 to adapter 76 must provide a liquid tight seal, and can be secured in any known manner, including by the use of a worm clamp or teflon tape.

With further reference to FIG. 2, the installation of fitting 14 in wall 12 will now be described. A one and one-quarter inch hole is drilled through wall 12 at a slight incline. The one inch diameter fitting 14 is then inserted through the hole of wall 12 and fixed into place by cement or grout. Fitting 14 is fixed at a slight incline such that coupling 70 is elevated relative to coupling 68. The inclined orientation of fitting 14 results in inlet channel 15 being inclined by an angle 78. Angle 78 is measured relative to the horizontal plane. The actual angle of incline is not critical. It is only necessary to have a slight incline, to allow free-standing liquid to self-drain out of inlet channel 15.

In the preferred embodiment, the liquid is drained out of inlet channel 15 through coupling 68. The invention is not limited to such a draining means. Any sanitary means for draining free-standing liquid from inlet channel 15 is considered within the scope of the present invention. For example, a dedicated drain port may be contained in inlet channel 15 which communicates with an auxiliary drainage tube. The draining of free-standing liquid from channel 15 is important to maintain a sanitary condition at the input end of apparatus 10.

In furtherance of the installation, four quarter inch holes are drilled into wall 12 in a square pattern around fitting 14. Lock box 58, which has an open rear side (See FIG. 2), is then placed over outer coupling 68 and positioned against the exterior surface of wall 12. One quarter inch lag bolts 59 are then threaded into the corresponding drilled holes to secure lock box 58 to wall 12.

Figure 3:
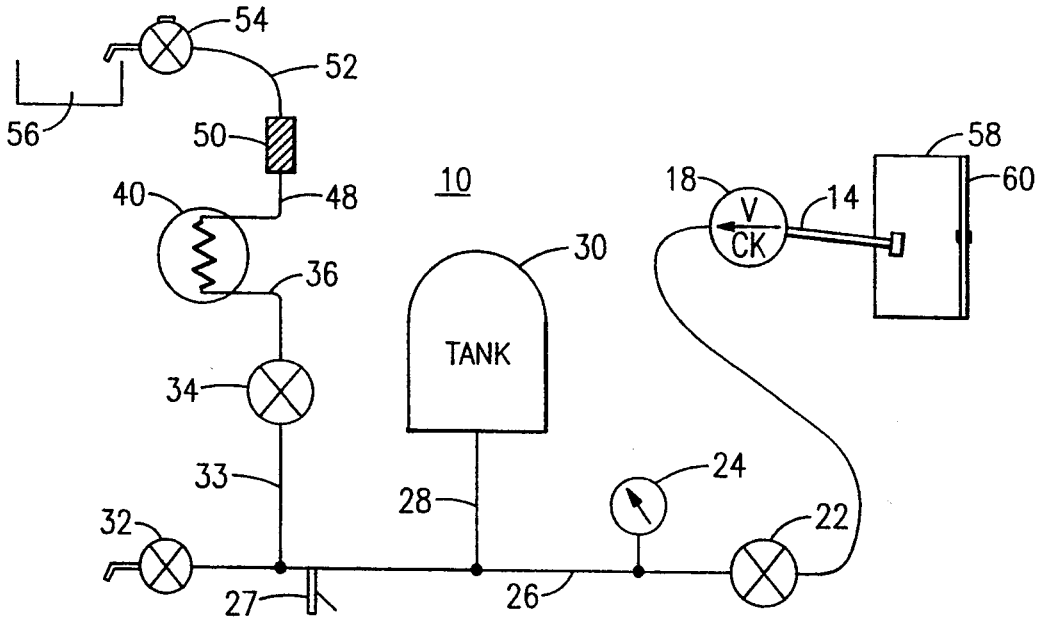
FIG. 3 is a schematic diagram of the dispensing apparatus of FIG. 1, showing the functional arrangement of the components of said apparatus.

In FIG. 3, there is shown a schematic representation of liquid dispensing apparatus 10, constructed according to the present invention. Potable liquid is supplied through fitting 14 under sufficient pressure to open check valve 18. The liquid passes through check valve 18 and travels to a normally open ball valve 22. The liquid passing through ball valve 22 is forced, under pressure from the outside source, through manifold 26 and into the diaphragm of tank 30. The level of pressure of the liquid is sufficient to overcome the elastic diaphragm and the pre-charge pressure in tank 30. During the filling procedure, water tap 32 is normally closed.

Upon the initial filling of tank 30, air contained in the discharge channel acts to prevent the liquid from entering extension pipe 33. In subsequent refilling operations, previously stored liquid, now residing in the discharge channel, prevents the new liquid from entering extension pipe 33.

If the pressure in tank 30 exceeds 80 pounds, pressure relief valve 27 opens, causing liquid to escape. Thus, relief valve 27 acts to limit the maximum pressure in tank 30 to 80 pounds. In the preferred embodiment, apparatus 10 is calibrated so that an 80 pound pressure reading at gauge 24 indicates a quantity of liquid in tank 30 of 40 gallons. An linear relationship between the pressure indicated on gauge 24 and the quantity of liquid contained in tank 30 is established between 0 and 40 gallons. Therefore, when gauge 24 reads 80 pounds, tank 30 should contain 40 gallons; when it reads 40 pounds, tank 30 should contain 20 gallons; and when it reads 10 pounds, tank 30 should contain 5 gallons of liquid.

Once the flow of liquid from the outside source has been stopped, check valve 18 closes. A closed check valve 18 prevents any liquid contained in pipe 28, manifold 26, ball valve 22 and tube 20 from escaping through fitting 14. Thus, the pressure level in tank 30 is maintained until liquid is released through the discharge channel and out of faucet 54.

Liquid is normally dispensed from apparatus 10 out through faucet 54, which is conveniently located at kitchen sink 56. Initially, air is trapped in the discharge channel between extension pipe 33 and faucet 54. This trapped air must be expelled through faucet 54 to establish a continuous flow of liquid from tank 30 to faucet 54. Upon the opening of faucet 54, both the expanded diaphragm and the pre-charge pressure in tank 30 force the liquid in the diaphragm to flow out to the discharge channel. That is, the liquid flows through pipe 28 and is forced into manifold 26. From there, it is directed up through extension pipe 33 and ball valve 34 which is normally open. From ball valve 34, it flows through tube 36 and chiller 40. Liquid that is already contained in chiller 40 before faucet 54 is opened, has become cold, and will be force up to faucet 54 as liquid from tank 30 flows into the discharge channel. From chiller 40 the liquid passes through tube 48, UV purifier and/or filter 50, and tube 52 before flowing out through faucet 54. The pre-charge pressure of 5 lbs in tank 30 is sufficient to produce a steady flow of liquid from tank 30 to faucet 54.

It is critical that the sanitary state of the potable liquid contained in apparatus 10 be maintained. At coupling 68, the point of entry to apparatus 10, contamination is most likely to occur. It is therefore an object of the present invention to provide a reliable means for sanitarily conveying potable liquid into apparatus 10. In the preferred embodiment, this objective is carried out by equipping coupling 66 and coupling 68 with corresponding sanitary preserving threads, such as an "acme" sanitary thread.

An enlarged elevation view of fitting 14 is shown in FIG. 4. Outer coupling 68 contains an acme sanitary thread 80. This type of thread is used in the pharmaceutical and food industry to insure sanitary connections between fittings. As shown in FIG. 4, the peaks of threads 80 are flat to provide additional surface area to which a corresponding thread on nozzle 66 will mate. The mating threads of coupling 66 and coupling 68 create a seal through which no air, liquid or foreign agents can penetrate. Thus, as sanitary liquid passes from coupling 66 through coupling 68, it remains sanitary.

With further reference to FIG. 4, inner coupling 70 is equipped with a conventional "standard" or "national" thread 82. Such a thread is typically used on plumbing pipes and their fittings. As indicated above with reference to FIG. 2, thread 82 mates with a corresponding thread contained on the inlet port of check valve 18.

As indicated above with reference to FIG. 2, contamination is further minimized at the point of entry to apparatus 10 by including a means, associated with inlet channel 15, for draining any free-standing liquid in channel 15. As used herein, the term "free-standing liquid" means liquid that is free from the force of pressure and other forces except gravity. Free-standing liquid would normally stand still on a horizontal surface and flow under the force of gravity down an inclined surface. In the preferred embodiment, inlet channel 15 is inclined so that any free-standing liquid therein flows, under the force of gravity (i.e., "self-draining" ), out through coupling 68.

In addition to sanitary fitting 14, the other components of apparatus 10 are recognized for their sanitary applications. Check valve 18 and ball valves 22 and 34 are all made of brass. Tubing 20, 36, 48 and 52 are made of clear polyvinyl chloride. Manifold 26, extension pipe 33, and the chilling coils in chiller 40 are all made of copper. Finally, purifier 50 contains a polypropylene chamber and faucet 54 is stainless steel. In assembly of apparatus 10, all threaded connections are sealed by wrapping teflon tape around the threaded male fitting of each such connection. Preferably, solder is completely avoided in the assembly of apparatus 10.

Referring to FIG. 5, there is a shown a rear elevation view of the distribution apparatus constructed in accordance with the present invention. Preferably, the distribution apparatus is embodied in tank truck 62. Supply tank 63 of truck 62 is mounted to a truck chassis in a well known manner. Tank 63 is a 1,600 gallon elliptical bulk pickup tank, designed to be truck mounted. This type of tank is commercially available, for example, from the Walker Stainless Equipment Company, Inc. of Tavares, Fla.

Tank 63 is constructed in a well known manner. It comprises an outer housing and inner vessel which are both made of stainless steel. The housing has a 18–20 gauge thickness and the vessel has a 12 gauge thickness. The vessel of tank 63 is the container for the potable liquid. The housing is reinforced by one-piece, aluminum I-beam rings, spaced along the housing. Between the housing and vessel, two inches of polystyrene insulation is contained along the sides and top, and two inches of polyurethane foam insulation is contained at the head and cradle areas. The cradle section of the housing is made of 12 gauge Corten steel, and serves as a mounting surface.

As shown in FIGS. 5 and 6, tank 63 contains a stainless steel manhole 84 with a stainless steel dust cover. The dust cover is held into place by four latches (not shown). Manhole 84 contains a Neoprene gasket to ensure a sealed closure. The dust cover may also contain a vent, such as a three inch Runovent. A stainless steel ladder 85 runs from manhole 84 down along the driver's side of tank 63 for easy access. A three inch inlet 86 communicates with the inner vessel of tank 63, and is located at the top of tank 63. Inlet 86 provides the passage through which potable liquid is supplied to tank 63. Inlet 86 includes a three inch sanitary shut-off valve. Tank 63 also contains two outlets communicating with the inner vessel of tank 63, a 1½ inch sanitary shut-off valve 87 and a three inch sanitary rear dump valve 88.

Tank 63 is a sanitary unit, designed to be "cleaned in place" (CIP). In this connection, dump valve 88 serves as a drain for cleaning and rinsing fluid sprayed inside the inner vessel of tank 63.

As shown in FIGS. 5 and 6, tank truck 62 contains an insulated rear cabinet 90 which contains various apparatus for conveying potable liquid from tank 63 to apparatus 10. A sanitary pump 92 includes an intake hose 93 threaded onto outlet valve 87 with a standard fitting. In the preferred embodiment, sanitary pump 92 should be able to pump up to eight gallons per minute at 80 pounds per square inch. Pump 92 may be, for example, a Model PR25 offered by the Tri-Clover Pump Company.

A discharge port on pump 92 (not shown) communicates with a flow meter 94. Flow meter 94 is used to measure and record quantities of liquid passing through its flow chamber. Meter 94 includes an auto-stop valve 96 which can be programmed to stop liquid flow when a preset quantity of liquid has passed through the flow chamber of the meter. Meter 94 also includes a register and printer unit 98 which provides a printed record of the quantity of liquid being dispensed. Meter 94 may be, for example, a Model No. E500, manufactured by the Neptune Meter Company.

A discharge port in flow meter 94 communicates with a conduit 100 which runs to an liquid purifier 102, as shown in FIGS. 5 and 6. Purifier 102 is an ultraviolet liquid treatment system similar to purifier 50, except that it has a flow rate of 6 to 8 gallons. Purifier 102 is powered by a standard 120 volt power source. Purifier 102 illuminates liquid passing through it with high intensity ultraviolet light to disinfect the liquid. Purifier 102 may also contain a sediment or carbon filter. Purifier 102 may be, for example, a UV 20 Series PURA ultraviolet water treatment system, manufactured by Pura of Provo, Utah.

An output port in purifier 102 is connected to a hose feed pipe 104 which is, in turn, connected through a coupling to sanitary supply hose 64. As shown in FIG. 5, hose 64 is wound around a power hose reel 106. Hose 64 is deployed by manually unwinding it from reel 106. An electric rewind motor 108 is coupled to reel 106 through a shaft and a simple gear system (not shown). Motor 108 is operated to rewind hose 64 after the filling of apparatus 10 has been completed. A 110 volt electric space heater 109 is also located in rear cabinet 90 to prevent the apparatus contained therein from freezing.

As shown in FIGS. 5 and 6, truck 62 further comprises a side cabinet 110 which houses a 5 Kilowatt diesel powered generator 112. Preferably, generator 112 is equipped with a remote ignition switch (not shown) located in rear cabinet 90. Electrical power to sanitary pump 92, flow meter 94, purifier 102, rewind motor 108, and heater 109 is supplied by generator 112 via a main power line 114. Power line 114 is routed to a multiple outlet junction box (not shown) located in cabinet 90.

In operation of the distribution apparatus, tank 63 of truck 62 is initially filled from a bulk liquid source through inlet 86. Pump 92 is then operated, with ball valve 67 open, to fill the liquid channel between outlet 87 and ball valve 67. Once liquid begins to flow out of nozzle 66, ball valve 67 is shut closed. Truck 62 is then driven to a location equipped with a dispensing apparatus of the present invention. Once at the location, hose 64 is manually unwound and brought to lock box 58 of apparatus 10. Door 60 of lock box 58 is unlocked and opened. Cap 16 is unscrewed from coupling 68, nozzle 66 is threaded onto coupling 68, and ball valve 67 is opened.

Next, generator 112 is started from the remote ignition switch in rear cabinet 90. Pump 92 is activated to draw liquid from tank 63, through outlet 87. The liquid is pumped through meter 94 which is continuously registering the quantity of liquid flowing through its flow chamber. Auto-stop valve 96 has been preset to automatically stop the flow of liquid upon registering a total quantity of 40 gallons. Register and printer unit 98 will record the dispensed quantity on paper tape.

As the liquid flows from meter 94, it is conveyed to purifier 102 through conduit 100. The liquid then flows unimpeded through purifier 102 at a rate of 6 to 8 gallons per minute. As it passes through purifier 102, the liquid is exposed to high intensity ultraviolet light. The light destroys any disease-causing micro-organisms that may have found their way into the system. The liquid flows from purifier 102, through feed pipe 104, and into sanitary hose 64.

Once a quantity of 40 gallons is registered on meter 94, auto-stop valve 96 operates to stop the flow of liquid to hose 64. Ball valve 67 is then manually closed, and nozzle 66 is unscrewed from coupling 68. Cap 16 is threaded back onto coupling 68, and door 60 is closed and locked. Pump 92 is deactivated, and motor 108 is activated to rewind hose 64 onto reel 106. Once hose 64 is rewound, generator 112 is shut off, and rear cabinet 90 and side cabinet 110 are secured.

Liquid remains in the channel between outlet 87 and ball valve 67 while truck 62 is out delivering liquid. At the end of a day, the liquid in the channel is drained back into tank 63. This is accomplished by disconnecting intake hose 93 from outlet 87, connecting nozzle 66 to inlet 86, and running pump 92 with ball valve 67 open.

While the present invention is applicable to potable liquids in general, it has particular application and advantages for distributing and dispensing spring water.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

We claim:

1. An apparatus for dispensing a potable liquid, comprising:

a faucet that can be opened or closed;

a storage tank for storing potable liquid supplied by an outside source;

a sanitary fitting containing a channel through which potable liquid is made to pass when said source is connected thereto, the channel being made to terminate at a first coupling at one end and at a second coupling at the other end, the first coupling being configured to connect to and disconnect from said source, the first coupling of said fitting having an acme sanitary thread contained thereon which is configured and dimensioned to closely mate with a corresponding acme sanitary thread contained on a corresponding coupling associated with said outside source, the channel being inclined to cause any free-standing liquid therein to drain out through the first coupling;

an intake channel having first and second ends, the first end being connected to said tank;

a check valve having its inlet end connected to the second coupling of said sanitary fitting and its discharge end connected to the second end of said intake channel;

a discharge channel, connected to said tank at one end and to said faucet at the other end; and first flow means, cooperating with said tank and said faucet, for causing a flow of liquid from said tank and through said discharge channel upon the opening of said faucet.

2. An apparatus as recited in claim 1, wherein said outside source comprises:

a supply vehicle;

a supply tank, mounted to said supply vehicle, for holding and transporting a supply of potable liquid;

second flow means, cooperating with said supply tank, for causing a flow of potable liquid from said supply tank;

a supply coupling, being configured and dimensioned to detachably connect to the first coupling of said sanitary fitting;

conveying means, connected at one end to said supply coupling and at another end to said supply tank, for conveying the flow of potable liquid to said supply coupling.

3. An apparatus as recited in claim 2, wherein said second flow means is an electric sanitary pump.

4. An apparatus as recited in claim 3, further comprising means, contained in-line with said conveying means, for sanitizing potable liquid as it flows through said conveying means to said supply coupling.

5. An apparatus as recited in claim 4, wherein said sanitizing means comprises a ultraviolet light purifier.

6. An apparatus as recited in claim 1, wherein said faucet is located in the interior of a building and said fitting is fixedly secured through a wall of said building, said wall having an interior surface and an exterior surface, the first coupling of said fitting being oriented to project out from the exterior surface of said wall.

7. An apparatus as recited in claim 6, further comprising a closure containing an acme thread that is configured and dimensioned to closely mate with the acme thread of said first coupling and seal the channel from outside exposure.

8. An apparatus as recited in claim 6, further comprising means, mounted to the exterior surface of said wall and surrounding the first coupling of said fitting, for securely housing the first coupling and preventing unauthorized access thereto.

9. An apparatus as recited in claim 1, wherein said first flow means includes an expandable diaphragm contained inside said storage tank and a pre-charge of pressure at a certain level between said storage tank and the diaphragm, the diaphragm being connected to the first end of said intake channel whereby liquid from said outside source can be received and stored in said diaphragm under pressure.

10. An apparatus as recited in claim 1, further comprising means, coupled to said discharge channel, for cooling potable liquid contained in said discharge channel.

11. An apparatus as recited in claim 1, further comprising means, contained in-line with said discharge channel, for sanitizing potable liquid as it flows through said discharge channel.

12. An apparatus as recited in claim 11, wherein said sanitizing means comprises an ultraviolet light purifier.

13. An apparatus as recited in claim 12, wherein said sanitizing means further comprises a filter.

14. An apparatus as recited in claim 11, wherein said sanitizing means comprises a filter.

15. An apparatus as recited in claim 1, wherein said potable liquid is spring water.

16. A method of distributing and dispensing a potable liquid, comprising the steps of:

transporting a bulk supply of potable liquid to a dispensing apparatus using a distribution vehicle, said distribution vehicle having a supply tank which contains the bulk supply of potable liquid, said dispensing apparatus having a faucet, a discharge channel connected to said faucet, a storage tank connected to said discharge channel, an intake channel connected to said storage tank a check valve, and a sanitary fitting which contains an inlet channel, the inlet channel of said fitting being made to terminate at a first coupling at one end and at a second coupling at the other end, said check valve having its inlet end connected to the second coupling of said fitting and its discharge end connected to said intake channel, the inlet channel of said fitting being inclined to cause any free-standing liquid therein to drain out through the first coupling, the first coupling of said fitting containing an acme sanitary thread;

detachably connecting said bulk supply of potable liquid to the first coupling of said sanitary fitting;

causing a flow of potable liquid from the supply tank of said distribution vehicle to the first coupling of said fitting;

sanitarily conveying the potable liquid through the inlet channel of said fitting, through said check valve and said intake channel, and to the storage tank of said dispensing apparatus; and detaching said bulk supply from the first coupling of said fitting, whereby any free-standing liquid in the inclined inlet channel drains out through the first coupling of said sanitary fitting.

17. A method as recited in claim 16, further comprising the steps of causing a flow of potable liquid from the storage tank of said dispensing apparatus upon the opening of the faucet of said dispensing apparatus; and conveying the flow of potable liquid to the faucet of said dispensing apparatus.

* * * * *